US006114948A

United States Patent [19]

Astell

[11] Patent Number: 6,114,948

[45] Date of Patent: Sep. 5, 2000

[54] SAFETY APPARATUS FOR PROVIDING INFORMATION TO A FIRE FIGHTER

[76] Inventor: Benjamin F. Astell, 755 N. Tratt St., Whitewater, Wis. 53190-2633

[21] Appl. No.: 09/249,026

[22] Filed: Feb. 12, 1999

[51] Int. Cl.[7] ..... G08B 5/00

[52] U.S. Cl. ..... 340/332; 340/539; 340/286.05; 340/577; 340/628

[58] Field of Search ..... 340/332, 539, 340/531, 287, 331, 286.05–286.06, 525, 825.28, 577, 628

[56] References Cited

U.S. PATENT DOCUMENTS

| | | | |
|---|---|---|---|
| 3,969,720 | 7/1976 | Nishino | 340/332 |
| 4,996,517 | 2/1991 | Kringen et al. | 340/506 |
| 5,828,294 | 10/1998 | Shank | 340/326 |
| 5,880,672 | 3/1999 | Weaver | 340/332 |

*Primary Examiner*—Thomas Mullen
*Assistant Examiner*—Anh La
*Attorney, Agent, or Firm*—David J. Archer

[57] ABSTRACT

A safety apparatus is disclosed for providing information to a fire fighter concerning the number of occupants of each room of a dwelling in the event of a fire. The apparatus includes an activator disposed externally relative to the dwelling, the activator being activated by the fire fighter in the event of a fire. A transmitter is electrically connected to the activator such that when the activator is activated, a signal is sent to the transmitter, the signal triggering a secondary signal which is transmitted by the transmitter. A receiver is located in each room of the dwelling, each receiver receiving the secondary signal from the transmitter, the receiver generating a pulse corresponding to the secondary signal. A strobe light is located within the same room of the dwelling as the receiver, the strobe light being electrically connected to the receiver so that the strobe light is energized by the pulse from the receiver. The strobe light is positioned such that the strobe light is visible from outside the dwelling, the strobe light emitting a visible signal corresponding with the number of occupants within the room for indicating to the fire fighter how many persons occupy each room of the dwelling.

15 Claims, 4 Drawing Sheets

SAFETY APPARATUS FOR PROVIDING INFORMATION TO A FIRE FIGHTER

FIELD OF THE INVENTION

The present invention relates to a safety apparatus for providing information to a fire fighter. More particularly, the present invention relates to a safety apparatus for providing information to a fire fighter concerning the number of occupants of each room of a dwelling in the event of a fire.

BACKGROUND OF THE INVENTION

Every year thousands of lives are lost due to the outbreak of fires in private dwellings as well as business offices. Usually, such deaths are due to smoke inhalation.

Typically, in the event of a fire, by the time fire fighters arrive at the incident, the dwelling has become filled with smoke and the fire fighters have to make an informed guess as to which rooms of the dwelling are likely to be occupied. Unfortunately, it often happens that a fire fighter will make a valiant effort to gain access to a smoke filled room only to find that this room is unoccupied. The time taken to reach the empty room not only endangers the life of the fire fighter but also wastes precious time needed to locate the occupants of other smoke filled rooms.

As will be appreciated by those skilled in the art of fire fighting, time is of the essence in a fire rescue operation and reliable information as to the occupancy of each room of a smoke filled dwelling would be extremely valuable in carrying out a successful rescue mission.

The present invention provides an apparatus which can be easily installed in a dwelling ahead of time, in order to provide vital information to a fire fighter in the event of a subsequent fire. Such apparatus provides the fire fighter with information as to how many persons should be expected to be within a particular room and also whether such occupants are adults or children.

Therefore, it is a primary feature of the present invention to provide a safety apparatus which overcomes the problems associated with determining how many persons occupy each room of a dwelling in the event of the dwelling becoming filled with smoke.

Another feature of the present invention is the provision of an apparatus which includes a strobe light placed in a window of the room of the dwelling to indicate how many persons occupy that room, such strobe light being remotely actuated by the fire fighter.

Other features and advantages of the present invention will be readily apparent to those skilled in the art by a consideration of the detailed description of the invention contained hereinafter taken in conjunction with the annexed drawings of a preferred embodiment of the present invention.

SUMMARY OF THE INVENTION

The present invention relates to a safety apparatus for providing information to a fire fighter concerning the number of occupants of each room of a dwelling in the event of a fire. The apparatus includes an activator disposed externally relative to the dwelling, the activator being activated by the fire fighter in the event of a fire. A transmitter is electrically connected to the activator such that when the activator is activated, a signal is sent to the transmitter, the signal triggering a secondary signal which is transmitted by the transmitter. A receiver is located in each room of the dwelling, each receiver receiving the secondary signal from the transmitter, the receiver generating a pulse corresponding to the secondary signal. A strobe light is located within the same room of the dwelling as the receiver, the strobe light being electrically connected to the receiver so that the strobe light is energized by the pulse from the receiver. The strobe light is positioned such that the strobe light is visible from outside the dwelling, the strobe light emitting a visible signal corresponding with the number of occupants within the room for indicating to the fire fighter how many persons occupy each room of the dwelling.

Many modifications and variations of the present invention will be readily apparent to those skilled in the art by a careful consideration of the detailed description of a preferred embodiment of the present invention taken in conjunction with the annexed drawings. However, such modifications and variations fall within the spirit and scope of the present invention as defined by the appended claims.

Included in such modifications would be the provision of a means disposed remote from the dwelling, such means including a transmitter which is able to be actuated by the fire fighter on the way to the fire so that immediately on arrival at the fire, the fire fighter is able to ascertain which rooms are occupied. The rescue vehicle in this case would be provided with encoded signals to prevent unauthorized activation of the system.

Also, the present invention envisages a strobe light which emits a series of flashes in accordance with the number of persons within that room. For example, two flashes would indicate two persons in that room.

Additionally, a secondary non intermittent strobe light could be mounted at the head of a babies crib so that in a smoke filled room, a smaller child or baby could be found quickly.

The present invention could also be incorporated within a carbon monoxide/smoke detection device. In this case, the carbon monoxide/smoke detector when activated, could be used to activate the aforementioned strobe light.

Also, the apparatus according to the present invention could be applied to office blocks so that teams of fire fighters would be able to quickly determine which offices are occupied.

BRIEF DESCRIPTION OF THE DRAWINGS

Similar reference characters refer to similar parts throughout the various views of the drawings.

DETAILED DESCRIPTION OF THE DRAWINGS

Figure 1:
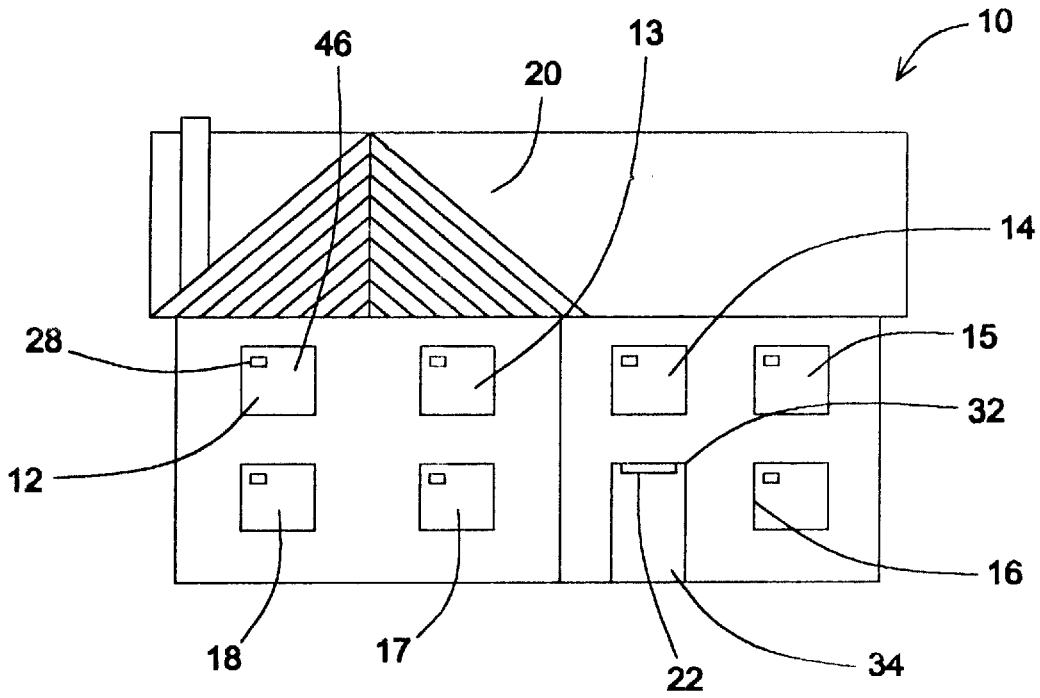
FIG. 1 is a side elevational view of the safety apparatus according to the present invention installed in a dwelling.

FIG. 1 is a side elevational view of the safety apparatus generally designated 10 according to the present invention. As shown in FIG. 1, the safety apparatus 10 is for providing information to a fire fighter concerning the number of occupants of each room 12, 13, 14, 15, 16, 17 and 18 of a dwelling 20 in the event of a fire.

Figure 2:
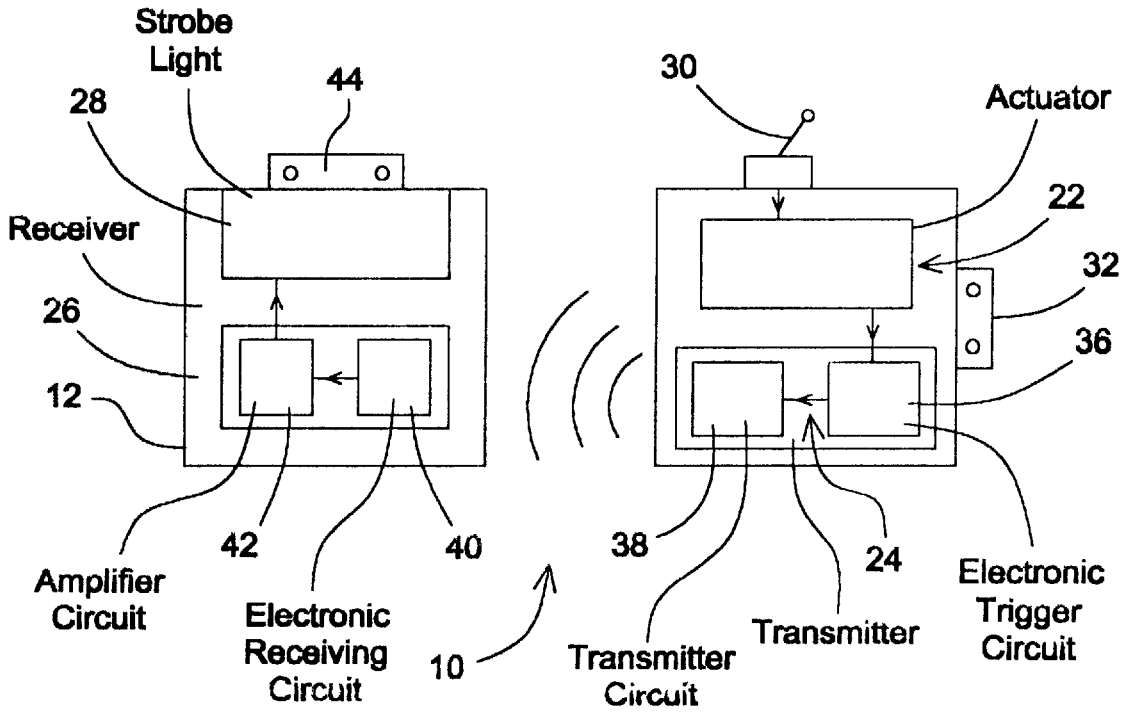
FIG. 2 is a schematic of the safety apparatus according to the present invention.

FIG. 2 is a schematic of the apparatus 10 shown in FIG. 1. As shown in FIG. 2, the apparatus 10 includes an activator generally designated 22 disposed externally relative to the dwelling 20, the activator 22 being activated by the fire fighter in the event of a fire. A transmitter generally designated 24 is electrically connected to the activator 22 such that when the activator 22 is activated, a signal is sent to the transmitter 24, the signal triggering a secondary signal which is transmitted by the transmitter 24. A receiver generally designated 26 is located in each room such as room 12 of rooms 12–18 of the dwelling 20. Each receiver 26 receives the secondary signal from the transmitter 24, the receiver 26 generating a pulse corresponding to the secondary signal. A strobe light 28 is located within the same room 12 of the dwelling 20 as the receiver 26, the strobe light 28 being electrically connected to the receiver 26 so that the strobe light 28 is energized by the pulse from the receiver 26. The strobe light 28 is positioned such that the strobe light 28 is visible from outside the dwelling 20, the strobe light 28 emitting a visible signal corresponding with the number of occupants within the room 12 for indicating to the fire fighter how many persons occupy each room 12–18 of the dwelling 20.

More particularly, a separate receiver and corresponding strobe light are located in each of the rooms 12–18 with each receiver receiving the same secondary signal from the transmitter 24.

In a more specific embodiment of the present invention, the activator 22 includes a switch 30 which is accessible to the fire fighter so that in the event of a fire, when the fire fighter closes the switch 30, the visible indication is emitted from each strobe light 28 associated with each room 12–18 of the dwelling 20 thereby indicating the occupancy of each room. The switch 30 could be a wireless "doorbell" type button.

Also, the activator 22 includes a bracket 32 for mounting the activator 22 above a doorway 34 of the dwelling 20 such that the activator 22 is out of reach of unauthorized individuals but is readily accessible to the fire fighter in the event of a fire.

Additionally, the transmitter 24 includes an electronic trigger circuit schematically represented by the box 36. The trigger circuit 36 is triggered by the signal from the activator 22. The transmitter 24 also includes a transmitter circuit represented by the block 38 for transmitting the secondary signal.

Moreover, the secondary signal is a radio frequency signal and the receiver 26 includes an electronic receiving circuit represented by the box 40, capable of receiving the secondary signal from the transmitter 24.

Also, the receiver 26 includes an amplifier circuit represented by the block 42, for amplifying the secondary signal received by the receiver 26 from the transmitter 24, the amplifier circuit 42 generating an electrical pulse corresponding to the secondary signal received from the transmitter 24.

The strobe light 28 is disposed integrally with the receiver 26 and includes a fastener 44 for fastening the strobe light 28 to a window 46 of the room 12 of the dwelling 20 such that the strobe light 28 is readily visible to the fire fighter in the event of a fire when the activator 22 has been activated.

Additionally, the strobe light 28 is preset to emit a visible signal in response to the pulse received from the receiver 26. More specifically, the strobe light 28 is preset to emit a visible signal which will inform the fire fighter as to how many persons occupy a particular room of the dwelling 20.

In a preferred embodiment of the present invention, the visible signal is color coded, the arrangement being such that a particular color corresponds to a particular number of occupants of the room, the visible signal being also color coded such that a particular color corresponds to a child occupying the room.

Figure 3:
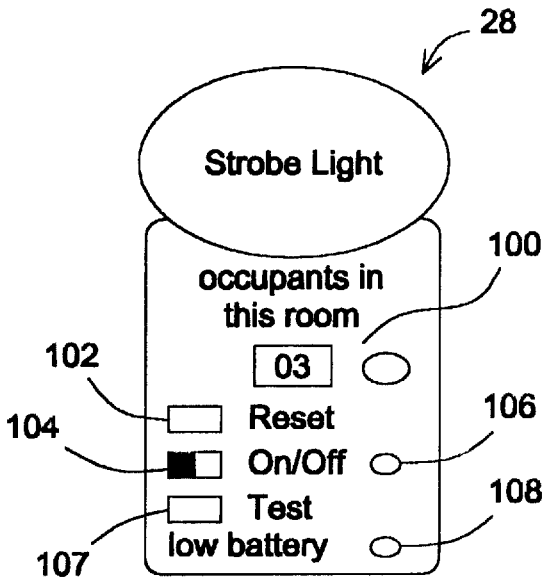
FIG. 3 is a view from inside a window of a strobe light of the safety apparatus according to the present invention.

FIG. 3 is a view from inside the window 46 of the strobe light 28 of the safety apparatus 10. As shown in FIG. 3, the strobe light 28 includes an indicator 100 for indicating the normal number of occupants of the room. The light 28 also includes a reset switch 102, an on/off switch 104 with a corresponding indicator light 106. A test button 107 is also included together with a further visual indicator 108 to indicate a low condition of a battery.

Figure 4:
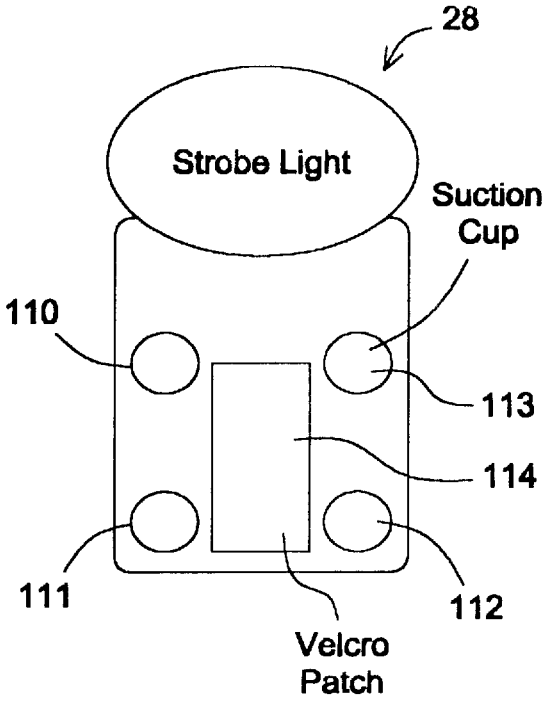
FIG. 4 is a view from outside a window of the strobe light shown in FIG. 3.

FIG. 4 is a view from outside the window 46 of the strobe light 28 shown in FIG. 3. As shown in FIG. 4, the strobe light 28 includes four suction cups 110, 111, 112 and 113 for securing the strobe light 28 onto the window 46. Additionally, a Velcro patch 114 is provided for alternatively securing the strobe light 28 to curtains or the like. Velcro is a Federal Registered Trade Mark. Alternatively, a magnet may be provided for securing the strobe light 28 to a metal surface or an adhesive strip may be used for holding the strobe light 28 in the required location.

Figure 5:
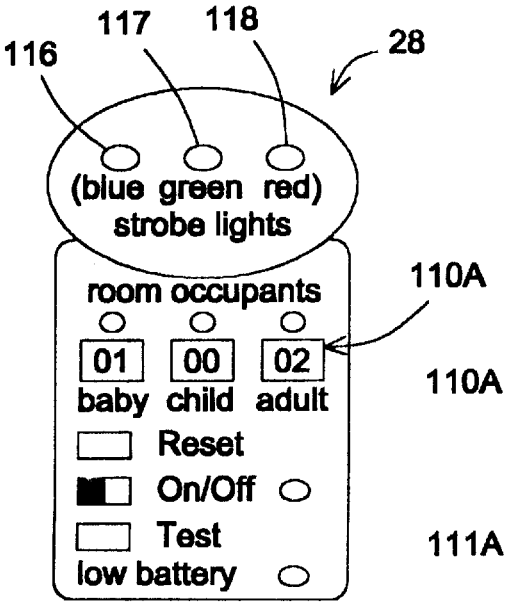
FIG. 5 is a view from inside a window of a strobe light of the safety apparatus according to another embodiment of the present invention.

FIG. 5 is a view from inside the window of a strobe light 28A of a safety apparatus according to another embodiment of the present invention. As shown in FIG. 5, the strobe light 28A includes three strobes 116, 117 and 118 for emitting a blue, green and red light respectively. An indicator 110A indicates the occupancy of the room. For example, as shown in FIG. 5, one baby is indicated by the blue light, no children are indicated by the absence of the green light and two adults are indicated by the red light.

Figure 6:
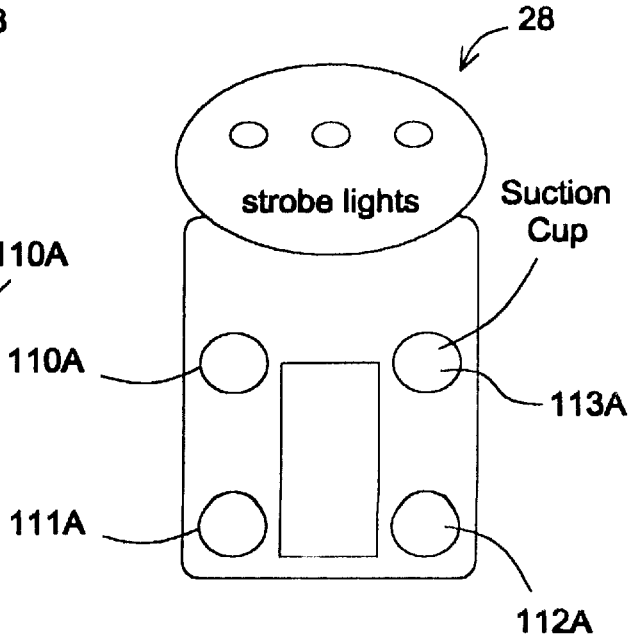
FIG. 6 is a view from outside a window of the strobe light shown in FIG. 5

FIG. 6 is a view from outside a window of the strobe light shown in FIG. 5. FIG. 6 is similar to FIG. 4 and includes suction cups 110A–113A for securing the light 28A to the window 46A. Preferably, the window mounted strobe lights 28A are AC/battery powered.

Figure 7:
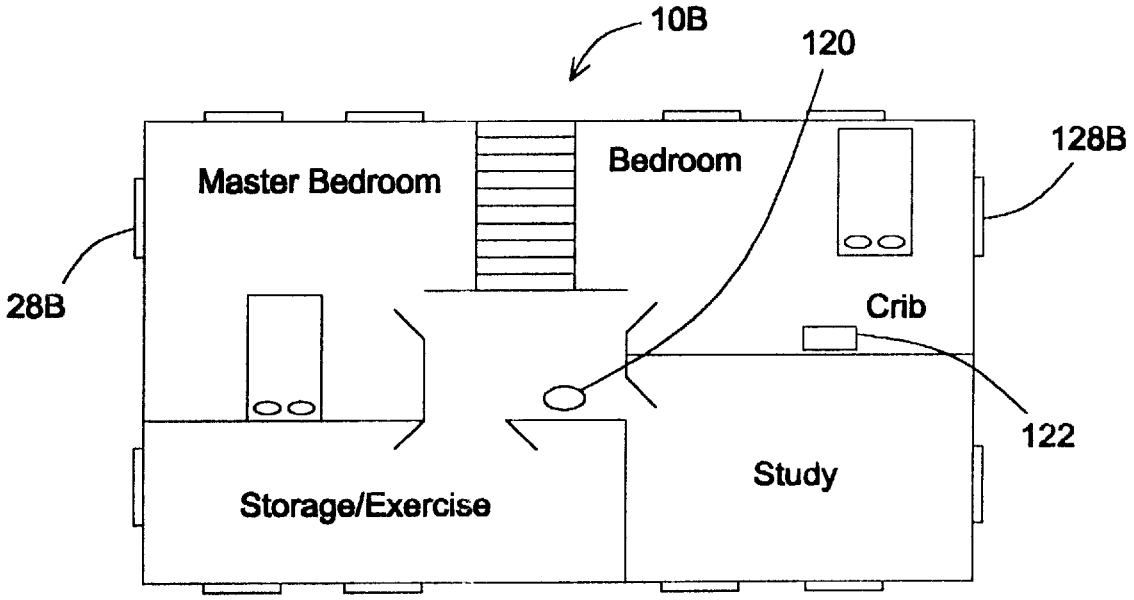
FIG. 7 is a plan view of a dwelling showing the disposition of the various components of the safety apparatus according to a further embodiment of the present invention.

FIG. 7 is a plan view of a dwelling showing the disposition of the various components of the safety apparatus 10B according to a further embodiment of the present invention. As shown in FIG. 7, a master unit 120 is powered by an AC power source with a battery backup. Also, strobe battery powered lights 28B and 128B located respectively in the master bedroom and the bedroom include relays which are activated by the master unit 120. The bedroom also includes a further strobe light 122 secured to a baby crib for enabling a firefighter to readily locate a baby in a smoke filled room.

Also, the master unit 120 could connect to the phone line or one of the household window units that is strobe lights so as to prevent multiple units calling from one building.

Figure 8:
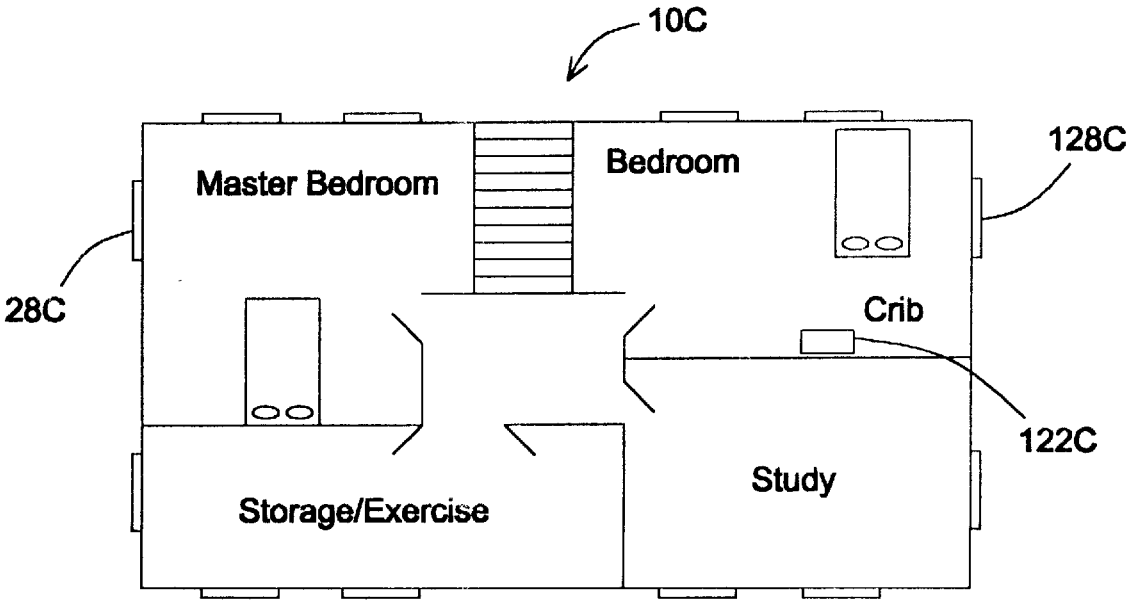
FIG. 8 is a plan view of a dwelling showing the disposition of the various components of the safety apparatus according to yet another embodiment of the present invention.

FIG. 8 is a plan view of a dwelling showing the disposition of the various components of a safety apparatus 10C according to yet another embodiment of the present invention. As shown in FIG. 8, no master unit is included and the strobe lights 28C and 128C together with strobe light 122C secured to a baby crib are activated by a signal from a transmitter the same as that shown in FIG. 2.

With regard to a rescue operation, fire departments typically practice on a "dummy" having an average weight of 140 pounds. Accordingly, rather than differentiate between adults and children on the basis of age, it would be preferable to categorize an adult being above 100 pounds and a child being less than 100 pounds.

Figure 9:
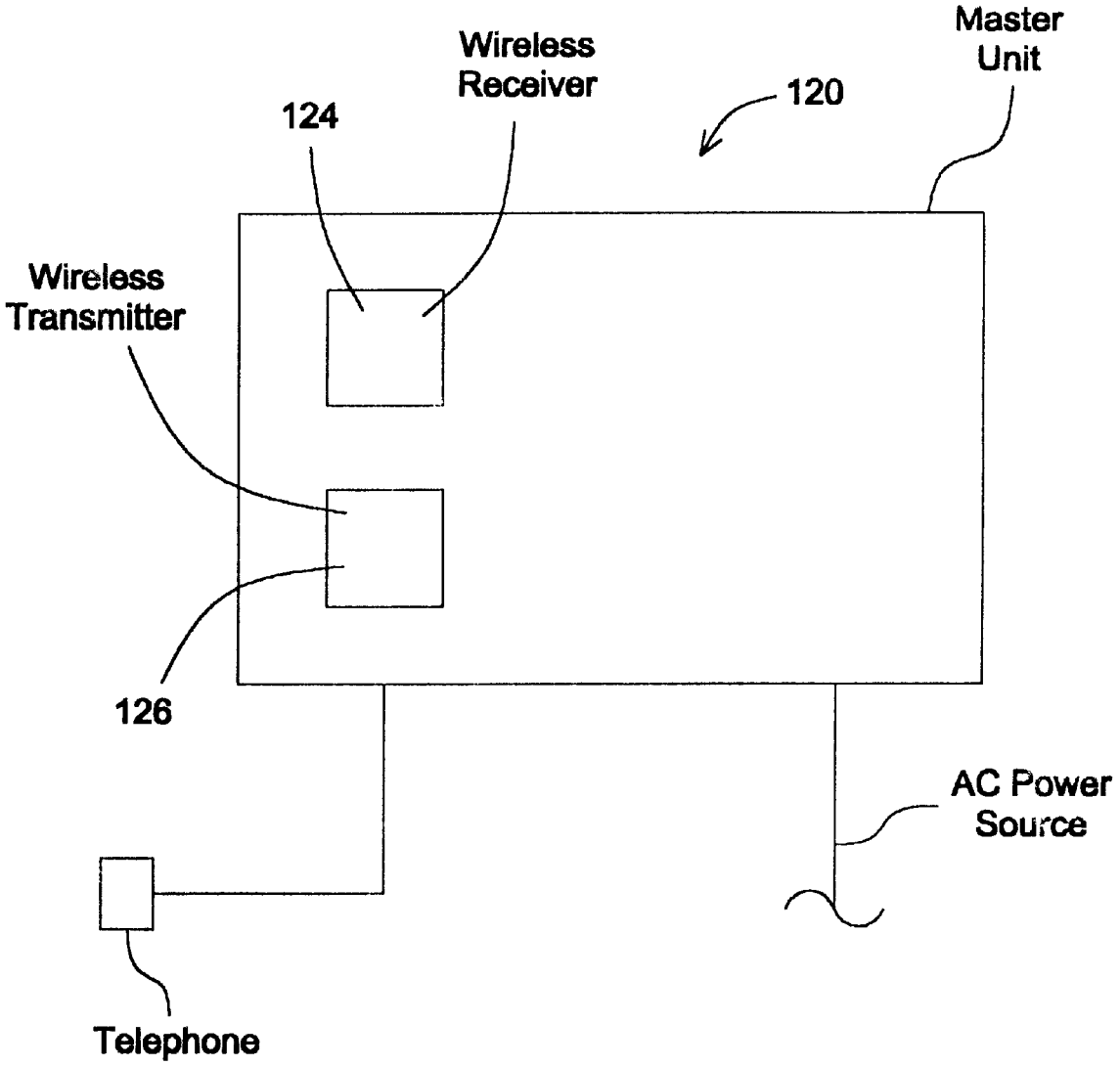
FIG. 9 is a schematic view of a master unit of the safety apparatus shown in FIG. 7.

FIG. 9 is a schematic view of a master unit 120 of the safety apparatus 10B shown in FIG. 7. As shown in FIG. 9, a wireless receiver 124 generates an impulse for activating a wireless transmitter 126 which initiates a telephone message to a local police or fire department for alerting such department of the fire hazard. The master unit 120, as shown in FIG. 7 is mounted in a central area of a dwelling and would be capable of re-transmitting a signal to all the strobe lights. Such window mounted strobe lights 28B and 128B could be AC/battery operated or just battery powered.

In operation of the safety apparatus 10 according to the present invention, in the event of a fire, a fire fighter on arriving at the scene of the fire immediately operates the switch 30 for actuating the activator 22 so that a secondary signal is transmitted by the transmitter 24. The secondary signal is received by each receiver such as receiver 26 disposed within each room 12–18 so that a corresponding strobe light 28 emits a visible signal which is observed by the fire fighter. Such vital information alerts the fire fighter as to how many persons need to be rescued from each room of the dwelling even if each of the rooms 12–18 is filled with smoke.

The apparatus according to the present invention emits a small strobe light on each side of a window or window frame area. Through the smoke, a fire fighter would readily identify the normal occupancy of each bedroom. The apparatus would give a series of flashes in accordance with how many persons were inside that room. For example, a series of three flashes would indicate three persons in that room.

For babies, a secondary non-intermittent strobe light would be mounted at the head of a crib so that, in a smoke filled room, a smaller child or baby could be found more quickly.

From a wireless "doorbell" type button, the strobe would be activated from directly outside the front door of the house or dwelling. The button would be mounted up high to prevent children from playing with the activator. In this way residents, home owners or emergency personnel would all be able to activate the safety system.

In an alternative arrangement, the apparatus would incorporate the use of a wireless system for transmitting a signal from a rescue vehicle. This arrangement would be similar in operation to a programmable TV remote. Also, individual cities would encode signals to prevent tampering with the system during a non-emergency situation.

Additionally, the apparatus according to the present invention could be incorporated with a carbon monoxide/smoke detector. Also, the strobe light device could be activated by an existing carbon monoxide/smoke detector.

More particularly, the arrangement would be such that activation of either the carbon monoxide sensor, the smoke sensor or the strobe light activator would trigger each other into the operational mode and more specifically would trigger a wireless signal for activating the strobe light arrangement.

Alternatively, the strobe light activator could be triggered by an audible tone from an existing fire detector. The activator would be preset to respond to a tone of a particular duration and would then transmit a signal for activating all the strobe lights in each room of the dwelling.

Furthermore, the activator could be preset so that after a predetermined delay, the activator would automatically dial the police department so that the police could drive to the residence to determine whether or not the fire department should be notified.

In a combination strobe light activator, carbon monoxide detector and smoke detector, a wireless signal by any of these units would activate the other unit so that if a fire started in a basement, the first alarm to go off would be the one in the basement. This alarm in the basement would not necessarily be heard by occupants upstairs. However, the alarm downstairs would send a signal to all of the detectors so that all the detectors would be activated. By such an arrangement, detectors not directly activated by the fire would become operational to warn people throughout the building of the imminent danger.

The safety system according to the present invention would be hard wired with an electrical battery back up. In certain applications, the system could be solely powered by a battery.

Additionally, a further strobe light would be disposed adjacent to the front door of the dwelling so that in the event of a fire, the further strobe light would be activated to identify for the rescue team the exact location of the house thus enhancing the rescue effort.

Moreover, the individual strobe lights within each room could include as disclosed hereinbefore color variations to indicate the size and age of the occupants of a room. For example, one blue flash, two green flashes and one yellow flash would represent one adult, two children and one infant.

The safety apparatus according to the present invention provides a low cost system that would provide occupants of a dwelling with a considerably improved safety factor compared to current fire safety equipment.

What is claimed is:

1. A safety apparatus for providing information to a fire fighter concerning the number of occupants of each room of a dwelling in the event of a fire, said apparatus comprising:

an activator disposed externally relative to the dwelling, said activator being activated by the fire fighter in the event of a fire;

a transmitter electrically connected to said activator such that when said activator is activated, a signal is sent to said transmitter, said signal triggering a secondary signal which is transmitted by said transmitter;

a receiver located in each room of the dwelling, each receiver receiving said secondary signal from said transmitter, said receiver generating a pulse corresponding to said secondary signal; and a strobe light located within the same room of the dwelling as said receiver, said strobe light being electrically connected to said receiver so that said strobe light is energized by said pulse from said receiver, said strobe light being positioned such that said strobe light is visible from outside the dwelling, said strobe light emitting a visible signal corresponding with the number of occupants within the room for indicating to the fire fighter how many persons occupy each room of the dwelling.

2. A safety apparatus as set forth in claim 1 wherein said activator includes:

a switch which is accessible to the fire fighter so that in the event of a fire, when the fire fighter closes said switch, said visible signal is emitted from each strobe light associated with each room of the dwelling thereby indicating the occupancy of each room.

3. A safety apparatus as set forth in claim 1 wherein said activator includes:

a bracket for mounting said activator above a doorway of the dwelling such that said activator is out of reach of unauthorized individuals but is readily accessible to the fire fighter in the event of a fire.

4. A safety apparatus as set forth in claim 1 wherein said transmitter includes:

an electronic trigger circuit which is triggered by said signal from said activator;

a transmitter circuit for transmitting said secondary signal.

5. A safety apparatus as set forth in claim 1 wherein said secondary signal is a radio frequency signal.

6. A safety apparatus as set forth in claim 1 wherein said receiver includes:

an electronic receiving circuit capable of receiving said secondary signal from said transmitter.

7. A safety apparatus as set forth in claim 1 wherein said receiver includes:

an amplifier circuit for amplifying said secondary signal received by said receiver from said transmitter, said amplifier circuit generating an electrical pulse corresponding to said secondary signal received from said transmitter.

8. A safety apparatus as set forth in claim 1 wherein said strobe light is disposed integrally with said receiver.

9. A safety apparatus as set forth in claim 1 wherein said strobe light includes:

a fastener for fastening said strobe light to a window of the room of the dwelling such that said strobe light is readily visible to the fire fighter in the event of a fire when said activator has been activated.

10. A safety apparatus as set forth in claim 1 wherein said strobe light is preset to emit a visible signal in response to said pulse received from said receiver.

11. A safety apparatus as set forth in claim 1 wherein said strobe light is preset to emit a visible signal which will inform the fire fighter as to how many persons occupy a particular room of the dwelling.

12. A safety apparatus as set forth in claim 11 wherein said visible signal is color coded, the arrangement being such that a particular color corresponds to a particular number of occupants of the room.

13. A safety apparatus as set forth in claim 11 wherein said visible signal is color coded such that a particular color corresponds to a child occupying the room.

14. A safety apparatus for providing information to a fire fighter concerning the number of occupants of each room of a dwelling in the event of a fire, said apparatus comprising:

an activator disposed externally relative to the dwelling, said activator being activated in the event of a fire;

a transmitter electrically connected to said activator such that when said activator is activated, a signal is sent to said transmitter, said signal triggering a secondary signal which is transmitted by said transmitter;

a receiver located in a room of the dwelling, said receiver receiving said secondary signal from said transmitter, said receiver generating a pulse corresponding to said secondary signal;

a strobe light located within the room of the dwelling, said strobe light being electrically connected to said receiver so that said strobe light is energized by said pulse from said receiver, said strobe light being positioned such that said strobe light is visible from outside the dwelling, said strobe light emitting a visible signal corresponding with the number of occupants within the room for indicating to the fire fighter how many persons occupy the room of the dwelling; and said strobe light being preset to emit a visible signal when activated to inform the fire fighter as to how many persons occupy the room of the dwelling.

15. A safety apparatus for providing information to a fire fighter concerning the number of occupants of each room of a dwelling in the event of a fire, said apparatus comprising:

an activator disposed externally relative to the dwelling, said activator being activated by the fire fighter in the event of a fire;

a transmitter electrically connected to said activator such that when said activator is activated, a signal is sent to said transmitter, said signal triggering a secondary signal which is transmitted by said transmitter;

a receiver located in each room of the dwelling, each receiver receiving said secondary signal from said transmitter, said receiver generating a pulse corresponding to said secondary signal;

a strobe light located within the same room of the dwelling as said receiver, said strobe light being electrically connected to said receiver so that said strobe light is energized by said pulse from said receiver, said strobe light being positioned such that said strobe light is visible from outside the dwelling, said strobe light emitting a visible signal corresponding with the number of occupants within the room for indicating to the fire fighter how many persons occupy each room of the dwelling; and said strobe light being preset to emit a visible signal when activated to inform the fire fighter as to how many persons occupy a particular room of the dwelling, said visible signal being color coded to correspond with a particular number of occupants of the room and to indicate whether a child occupies the room.

* * * * *